US005273403A

United States Patent [19]

Im et al.

[11] Patent Number: 5,273,403

[45] Date of Patent: Dec. 28, 1993

[54] CONTROL SYSTEMS FOR VARIABLE DISPLACEMENT HYDRAULIC PUMPS

[75] Inventors: Lak bok Im; An Hong Park; Jin Seop Shin, all of Changwon, Rep. of Korea

[73] Assignee: Samsung Heavy Industries Co., Ltd., Changwan, Rep. of Korea

[21] Appl. No.: 980,327

[22] Filed: Nov. 23, 1992

[30] Foreign Application Priority Data

May 30, 1992 [KR] Rep. of Korea ..... 92-9416

[51] Int. Cl.[5] ..... F04B 49/08

[52] U.S. Cl. ..... 417/213; 417/218; 417/222.1; 92/12.1; 91/384

[58] Field of Search ..... 417/213, 218, 222.1; 92/12.1, 12.2; 91/384

[56] References Cited

U.S. PATENT DOCUMENTS

| | | | |
|---|---|---|---|
| 3,510,231 | 5/1970 | Bobst | 417/218 |
| 3,788,773 | 1/1974 | Van Der Kolk | 417/213 |
| 4,013,381 | 3/1977 | Hein et al. | 417/222.1 |
| 4,518,322 | 5/1985 | Nonnemacher | 417/222.1 |
| 4,710,106 | 12/1987 | Iwata et al. | 417/213 |
| 4,715,788 | 12/1987 | Kouns et al. | 417/222.1 |
| 5,197,864 | 3/1993 | Lunzman et al. | 417/222.1 |

FOREIGN PATENT DOCUMENTS

| | | | |
|---|---|---|---|
| 113276 | 6/1984 | Japan | 417/213 |
| 1116294 | 5/1989 | Japan | 417/222.1 |
| 227881 | 9/1989 | Japan | 417/148 |
| 3107579 | 5/1991 | Japan | 417/222.1 |

*Primary Examiner*—Richard A. Bertsch
*Assistant Examiner*—Roland G. McAndrews, Jr.
*Attorney, Agent, or Firm*—Abelman, Frayne & Schwab

[57] ABSTRACT

A control system for a variable displacement hydraulic pump with a two-lever type of feedback lever mechanism. The control system comprises a pressure responding ram for causing, upon receiving pump output pressure or outside pilot pressure, a servo spool of a servo valve to be displaced, the servo valve for causing a larger chamber of a servo cylinder to be selectively supplied with the pump output pressure, the servo cylinder for controlling angle of inclination of a swash plate of the pump in order to control the pump output flow rate, a two-lever type of feedback lever mechanism for linking the pressure responding ram, the servo spool of the servo valve and the servo piston of the servo cylinder to each other. The lever mechanism comprises a feedback lever linked at one end to the servo piston and at the other end to both the horsepower control part and the flow control part and a connection lever linked at one end to the feedback lever, hinged at the other end to a frame of the control system and linked at its predetermined middle portion to the servo spool of the servo valve. The present control system independently simultaneously controls horsepower and flow rate of the pump according to both the pump output pressure and the outside pilot pressure which are supplied to the pressure responding ram.

7 Claims, 4 Drawing Sheets

CONTROL SYSTEMS FOR VARIABLE DISPLACEMENT HYDRAULIC PUMPS

BACKGROUND OF THE INVENTION

1. Field of the Invention

The present invention relates in general to a control system for a variable displacement hydraulic pump, and more particularly to a feedback control system for a variable displacement hydraulic pump which is provided with a two-lever type of feedback lever mechanism and in which a horsepower control ram, displacing in response to a horsepower control signal, and a flow control ram, displacing in response to a flow control signal, are coaxially arranged, thereby controlling both the horsepower and the flow rate of the variable displacement hydraulic pump with a simple construction.

2. Description of the Prior Art

In order to control flow rate and horse power of variable displacement hydraulic pumps, especially for generating hydraulic power, there have been proposed several types of feedback control systems such as depicted in FIG. 1. This drawing shows a schematic circuit diagram of a known control system for such a variable displacement hydraulic pump which is disclosed in Japanese Patent Laid-open Publication No. Heisei. 1-116294. With reference to this drawing, the known control system includes a servo valve 3 or a speed control valve which is displaceable between three positions, a hydraulic feeding position at which a hydraulic fluid under pressure is supplied to a larger chamber 1*a* of a servo cylinder 10 by way of a charge conduit 2, a neutral position at which the conduit 2 is closed and a drain position at which the hydraulic fluid under pressure is discharged from the larger chamber 1*a* of the servo cylinder 10 to an oil reservoir (not shown) through the servo valve 3. This servo valve 3 has a servo spool 3*a* of which one end is linked, using a feedback lever 5, to a servo piston 4 of the servo cylinder 10. In addition, this known control device is provided with a horsepower control pilot ram 7, a flow control pilot ram 8 and a link mechanism comprising two levers 9*a* and 9*b*, which are connected to the pistons 7*a* and 8*a* of the control pilot rams 7 and 8, respectively. The link mechanism 9*a* and 9*b* selects one of the two control pilot rams 7 and 8 which displaces less than the other and causes the feedback lever 5 to actuate in accordance with the displacement of the selected ram 7 or 8. Here, the horsepower control pilot ram 7 has the pilot piston 7*a* which is displaceable in response to a pump output pressure Pd of a variable displacement pump 6, while the flow control pilot ram 8 has the pilot piston 8*a* which is displaceable in response to an outside pilot pressure Pi.

In the drawing, the reference numeral 6*a* denotes a swash plate or an inclined axis of the pump 6 of which the inclination angle is changed in accordance with the displacement of the servo piston 4 of the servo cylinder 10.

However as noted, this type of control system necessarily becomes a complicated three-lever type of system since it has three levers, that is, the feedback lever 5, the horsepower control lever 9*a* and the flow control lever 9*b*, in order to simultaneously independently perform the constant horsepower control and the flow rate control. Furthermore, the horsepower control pilot ram 7, having the pilot piston 7*a* and a spring 7*b*, and the flow control pilot ram 8, having the pilot piston 8*a* and a spring 8*b*, are independently cooperated with the separated levers 9*b* and 9*a* of the link mechanism. In result, this type of known control system has a disadvantage in that it has serious problems caused by difficulty of design and preparation thereof and striving to accomplish a desired accuracy. Furthermore, this control system has many link points because it is provided with the three levers 5, 9*a* and 9*b* linked to each other as described above and this causes these link points to be necessarily abraded as it is used for a long time, as a result, another problem of this system resides in the pass the possibility of deterioration of control performance of the system due to the accumulated abrasion of the link points.

SUMMARY OF THE INVENTION

It is, therefore, an object of the present invention to provide a control system for a variable displacement hydraulic pump in which the aforementioned problems can be overcome and which is provided with a two-lever type of simple feedback lever mechanism instead of the three-lever type of complicated lever mechanism in order to reduce the number of link points to as few as is possible.

It is another object of the present invention to provide a control system for a variable displacement hydraulic pump in which a horsepower control ram, displacing in response to a horsepower control signal, and a flow control ram, displacing in response to a flow control signal, are coaxially arranged such that they are integrated with each other, thereby simplifying its construction by virtue of reduction of the number of required elements, improving its control performance owing to reduced number of link points and accomplishing the compactness.

In an embodiment of the present invention, the aforementioned objects can be obtained by providing a control system for a variable displacement hydraulic pump comprising: a pressure responding ram for causing, upon receiving pump output pressure or outside pilot pressure, a servo spool of a servo valve to be displaced, said ram comprising a horsepower control part which is displaced in response to said pump output pressure and a flow control part which is displaced in response to said outside pressure, said control parts being coaxially arranged in order to be integrated with each other; said servo valve for causing a larger chamber of a servo cylinder to be selectively supplied with the pump output pressure, the servo valve having said servo spool therein, the servo spool displacing, in accordance with the displacement of said pressure responding ram, between a hydraulic feeding position, a neutral position and a drain position; said servo cylinder for controlling angle of inclination of a swash plate of said pump in order to control the pump output flow rate, said servo cylinder enclosing a servo piston which divides the inside of the servo cylinder into smaller and larger chambers, said smaller chamber being always supplied with the pump output pressure and said larger chamber communicating with the inside of said servo valve through a conduit in order to be selectively supplied with the pump output pressure; and a two-lever type of feedback lever mechanism for linking said pressure responding ram, said servo spool of the servo valve and said servo piston of the servo cylinder to each other, said mechanism comprising: a feedback lever being linked at one end thereof to the servo piston and at the other end thereof to both the horsepower control part and the flow control part of the pressure responding ram; and a connection lever being linked at one end thereof to said feedback lever, hinged at the other end thereof to a frame of said control system and linked at its predetermined middle portion to the servo spool of the servo valve, whereby said control system independently simultaneously controls constant horsepower and flow rate of the pump in accordance with both the pump output pressure and the outside pilot pressure which are supplied to the pressure responding ram.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
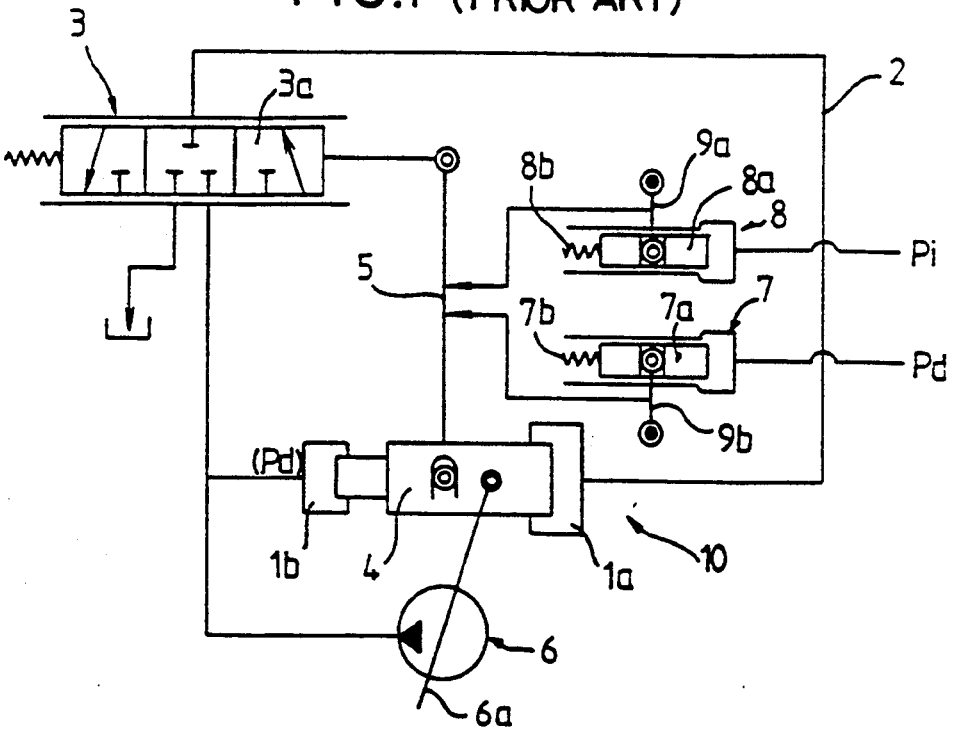
FIG.1 (PRIOR ART)
FIG. 1 is a schematic circuit diagram of a known three-lever type of control system for a variable displacement hydraulic pump.
Figure 2:
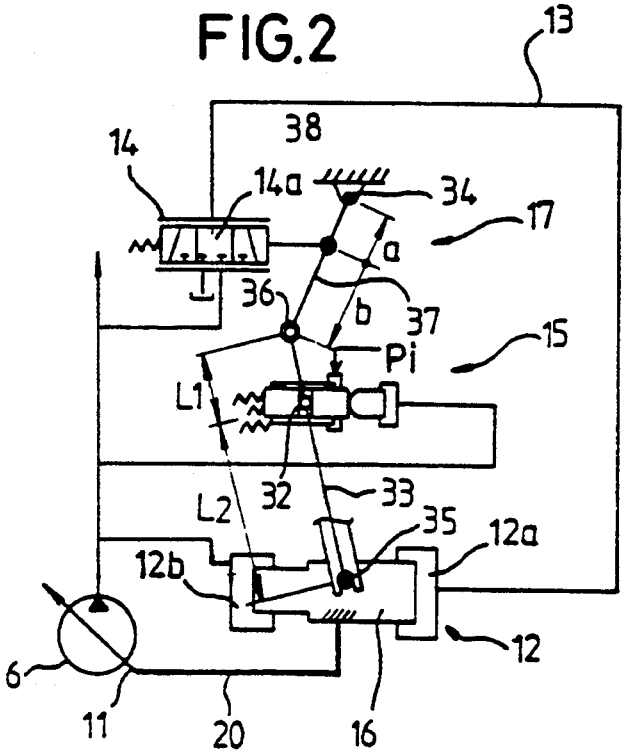
FIG. 2 is a view corresponding to FIG. 1, but showing an embodiment of a two-lever type of control system in accordance with the present invention.
Figure 3:
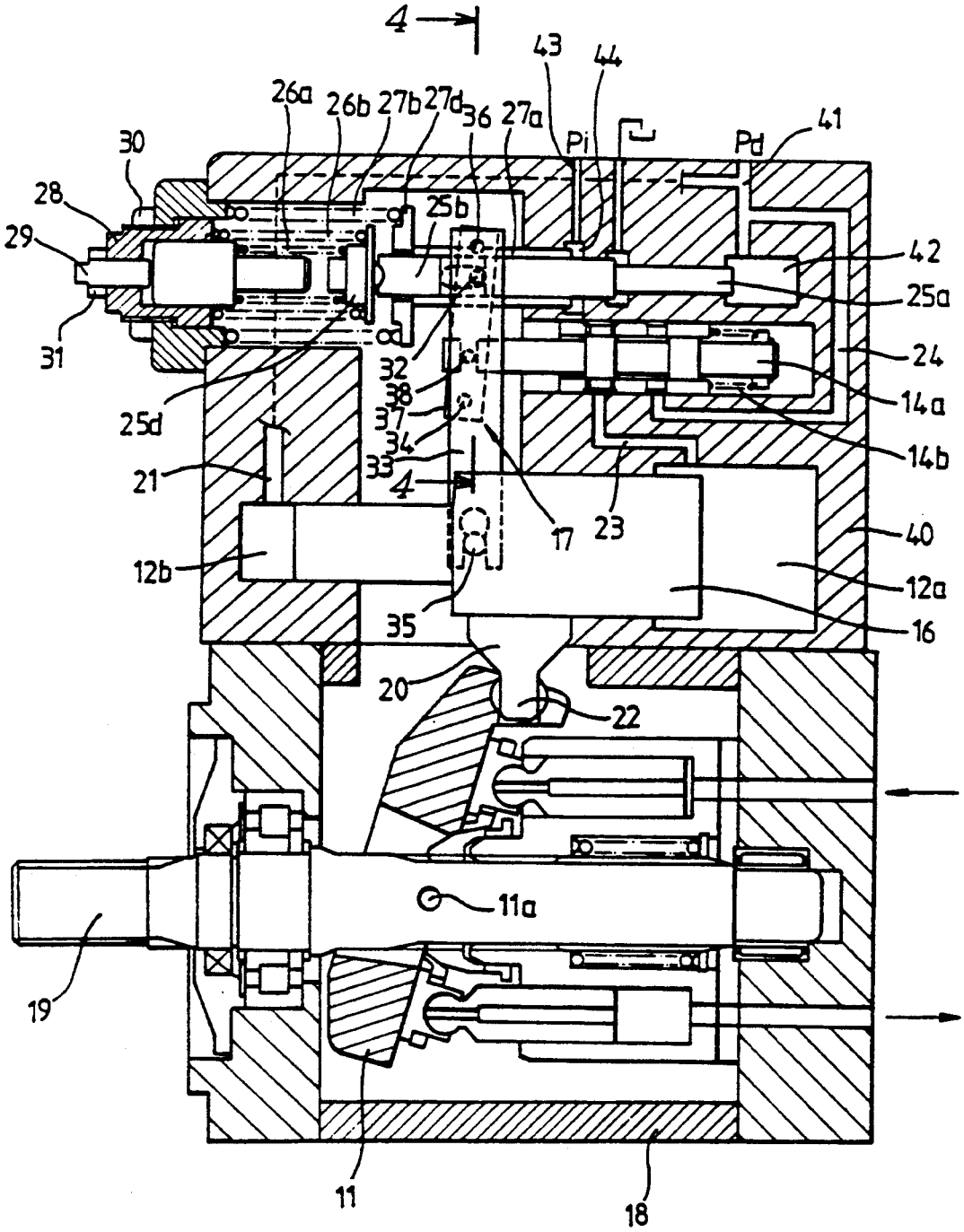
FIG. 3 is a sectioned view of the variable displacement hydraulic pump incorporating the control system of the present invention.

With reference to FIGS. 2 and 3, FIG. 2 shows a schematic circuit diagram of an embodiment of a two-lever type of control system for a variable displacement hydraulic pump according to this invention and FIG. 3 is a sectioned view of the variable displacement hydraulic pump incorporating the present control system.

Referring first to FIG. 2, the present control system includes, in similar to the prior art, a servo cylinder 12 for regulating the inclination angle of a swash plate 11 (or inclined axis) of a variable displacement hydraulic pump 6 and a servo valve 14 or a speed control valve for supplying a hydraulic fluid under pressure, that is, the pump output pressure Pd, to a larger chamber 12*a* of the servo cylinder 12 of a hydraulic servo mechanism by way of a charge conduit 13. However differently from the prior art, an integrated pressure responding piston part or a pressure responding ram 15 is provided for the system so as to be displaced in response to both the outside pilot pressure Pi and the pump output pressure Pd. In order to make the servo valve 14, the pressure responding ram 15 and a servo piston 16 of the servo cylinder 12 be linked to each other, the present system is provided with a two-lever type of feedback lever mechanism 17.

Turning to FIG. 3, the servo piston 16 of the servo cylinder 12 is arranged such that it is parallel to a drive shaft 19 inside a housing 18 and connected to an end of the swash plate 11, which incorporates with the drive shaft 19, by means of a tilting pin 20. The servo cylinder 12 is divided into two variable chambers, that is, larger and smaller chambers 12*a* and 12*b*, by the servo piston 16 which longitudinally slides therein. Here, the smaller chamber 12*b* communicates with a conduit 41, through which the pump output pressure Pd is supplied to the pressure responding ram 15 and the servo valve 14, through a conduit 21 and, in this respect, it is always applied with the pump output pressure Pd. In connection of the tilting pin 20 to the swash plate 11 of the pump 6, a ball joint 22 is used so as to cause the swash plate 11 to wobble centering around a wobble point 11*a* thereof when the servo piston 16 of the servo cylinder 12 is displaced. If the swash plate 11 wobbles centering around the wobble point 11*a* as described above, the inclination angle of the swash plate 11 is varied. The servo valve 14 is provided therein with a servo spool 14*a* which longitudinally slides in the valve 14 in order to make the conduit 23, communicating with the larger chamber 12*a* of the servo cylinder 12, be opened or closed. In other words, when the servo spool 14*a* moves leftwards of FIG. 3 in order to accomplish the hydraulic feeding position, the pump output pressure Pd of the conduit 24 is applied to the larger chamber 12*a* of the servo cylinder 12 through the open conduit 23, while the pump output pressure Pd is discharged from the larger chamber 12*a* of the cylinder 12 to an oil reservoir (not shown) in the housing 18 when the servo spool 14*a* of the servo valve 14 moves rightwards of FIG. 3 in order to accomplish the drain position at which the conduit 23 communicates with the inside of the housing 18. On the other hand, when the servo spool 14*a* is disposed at its neutral position as depicted in this drawing, the conduit 23 is closed and this causes the servo piston 16 of the servo cylinder 12 to stop its movement.

The pressure responding ram 15 generally comprises two parts, that is, a horsepower control part 25 which responds to the pump output pressure Pd and a flow control part 27 which responds to the outside pilot pressure Pi. Here, the horsepower control part 25 includes a pump output pressure responding piston 25*a*, which moves in response to the pump output pressure Pd passing through the conduit 41 in order to be received by the cylinder chamber 42, a pair of biasing members 26*a* and 26*b*, preferably compression coil springs, for generating biasing force Fs which is to stand against the hydraulic power Pd.A resulting from multiplying the pump output pressure Pd by the sectional area A of the piston 25*a*. In addition, a pressure transfer spool 25*b* is provided in order to transfer the biasing force of the piston 25*a*, that is, the hydraulic power Pd.A, to the biasing members 26*a* and 26*b*. Also, in order to commonly support the ends of the biasing members 26*a* and 26*b*, a support member 25*d* is provided such that it is tightly interposed between the pressure transfer spool 25*b* and the biasing members 26*a* and 26*b*.

Similarly to the construction of the horsepower control part 25, the flow control part 27 comprises a flow control piston 27a for generating the hydraulic power upon receiving the outside pilot pressure Pi passing through the conduit 43 in order to be applied to the cylinder chamber 44 and a biasing member 27b, preferably a compression coil spring, for generating biasing force which is to stand against the hydraulic power generated by the flow control piston 27a.

In addition, the pressure responding ram 15 is provided at its one end with adjusting screws 28 and 29 and lock nuts 30 and 31 for adjusting the biasing force or the spring force of the biasing members 26a and 26b.

Figure 7:
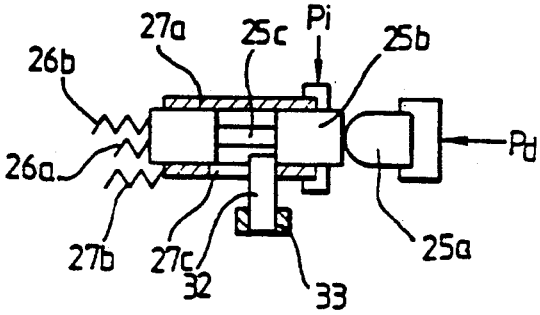
FIG. 7 is a schematic view showing a construction of a pressure responding piston part of the control system of FIG. 3.

Here, the pressure transfer spool 25b of the horsepower control part 25 is inserted, as depicted in detail in FIG. 7, in the sleeve-type flow control piston 27a of the flow control part 27 such that the former freely axially reciprocates with respect to the movable latter. On the other hand, the pressure transfer spool 25b is formed with a middle part 25c having a smaller diameter than the other part, while the sleeve-type piston 27a has a longitudinal slot 27c, preferably having a rectangular or elliptic shape, at its middle portion in order to receive a first pin 32. This first pin 32 is freely movable within a predetermined range, that is, the range decided by the slot 27c, without interference caused by the pressure transfer spool 25b and the flow control piston 27a. Also, the three biasing members 26a, 26b and 27b are independently arranged with respect to each other such that there occurs no interference therebetween.

Figure 4:
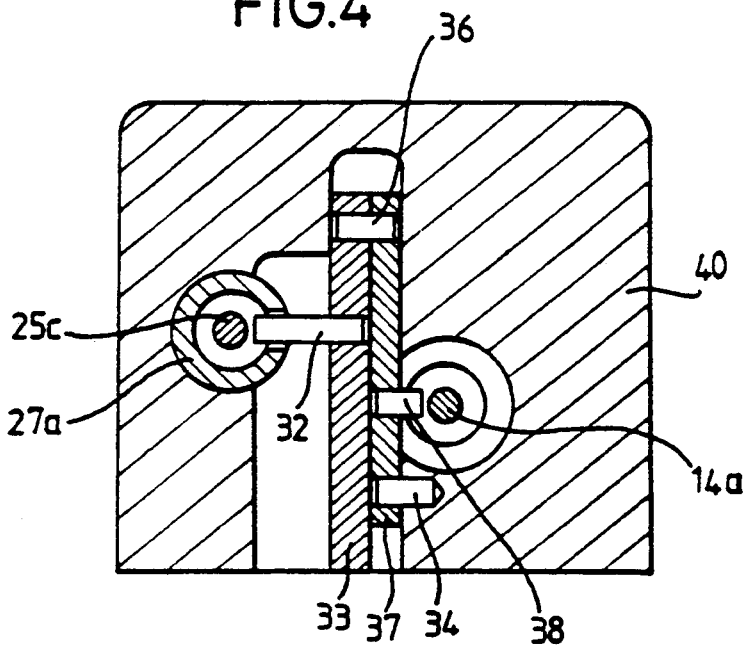
FIG. 4 is a sectioned view of an embodiment of a two-lever type of link mechanism taken along the section line A—A of FIG. 3.

The feedback lever mechanism 17 is provided with a feedback lever 33 and a connection lever 37. Here, the feedback lever 33 is linked at its upper end to both the pressure transfer spool 25b of the horsepower control part 25 and the flow control piston 27a of the flow control part 27 by means of the first pin 32 as shown in FIG. 3. Moreover, this lever 33 is hinged at its lower end to a middle part of the servo piston 16 of the servo cylinder 12 by a second pin 35, at the same time, it is linked to the connection lever 37 by a third pin 36. On the other hand, the connection lever 37 is linked to an end of the servo spool 14a of the servo valve 14 by a fourth pin 38 and hinged to a bracket or a frame 40 of the present control system by a fifth pin 34. Therefore, when the first pin 32 linked to the pressure responding ram 15 is displaced, the feedback lever 33 turns about the second pin 35 linked to the servo piston 16 of the servo cylinder 12 and this causes the connection lever 37 to turn about the fifth pin 34 linked thereto in order to make the servo spool 14a of the servo valve 14 be displaced (see FIG. 4).

The operational effect of the present control system having the aforementioned construction will be described hereinafter.

In performing the horsepower control shown in FIG. 3 as the pump output pressure Pd passing through the conduit 41 is increased, there is necessarily generated considerable hydraulic power acting on the end surface of the pump output pressure responding piston 25a and this causes the biasing members 26a and 26b, normally biasing the pressure transfer spool 25b rightwards, to be displaced leftwards in accordance with the hydraulic power. At this time, due to the leftward displacement of the biasing members 26a and 26b, the feedback lever 33 turns counterclockwise about the second pin 35. In result, the servo spool 14a of the servo valve 14, recognized as linked to feedback lever 33 by in series the fifth pin 34, the connection lever 37 and the fourth pin 38, is displaced leftwards and, in this respect, this spool 14a at the neutral position moves leftwards of FIG. 3 in order to accomplish its hydraulic feeding position. Here with reference to FIG. 2, the displacement D of the servo spool 14a of the servo valve 14 in the case of displacement $\alpha$ of the pressure transfer spool 25b will be represented as follows:

$$D=(L_1+L_2)/L_2\cdot(a+b)/a\cdot\alpha$$

wherein $L_1$ is a distance between the first and third pins 32 and 36;

$L_2$ is a distance between the first and second pins 32 and 35;

a is a distance between the fourth and fifth pins 38 and 34; and b is a distance between the third and fourth pins 36 and 38.

When the servo spool 14a is located at its hydraulic feeding position as aforementioned, the pump output pressure Pd is supplied to the larger chamber 12a of the servo cylinder 12 through the conduits 24 and 23 in series. As a result, higher hydraulic power is generated on the larger chamber-side 12a end surface of the servo piston 16, while lower hydraulic power is generated on the smaller chamber-side 12b end surface because of a real difference between larger chamber-side 12a and smaller chamber side 12b, to which the same pump output pressure Pd is supplied through the conduit 21, of the servo piston 16 and this causes the servo piston 16 to move leftwards. In accordance, the tilting pin 20 moves leftwards together with the servo piston 16 so that the swash plate 11, hinged at its end to the tilting pin 20 by the ball joint 22, wobbles leftwards in order to reduce its angle of inclination and this makes the output flow rate Q of the pump 6 be reduced.

At this time, since the servo piston 16 moves leftwards as described above, the feedback lever 33, linked to the servo piston 16 by the second pin 35, turns clockwise about the first pin 32. Due to the force equilibrium of biasing members 26a, 26b and the hydraulic force acting on the surface of piston 25a, this turning of the feedback lever 33 makes the third pin 36 turn clockwise about the first pin 32. This results in the connection lever, of which one end is hinged to the frame 40 by the fifth pin 34 and the other end is linked to the feed back lever 33 by the third pin 36, to turn clockwise about the fifth pin 34. In accordance, the servo spool 14a, linked to the connection lever 37 by the fourth pin 38, moves rightwards and, in this respect, shifts its position from the hydraulic feeding position to the neutral position in order to cause the conduit 23 to be blocked and the servo piston 16 to stop its movement.

At this state, when the pump output pressure Rd is reduced, the piston 25a responding to the pump output pressure Pd moves rightwards by virtue of the resilient force of the biasing members 26a and 26b in order to cause the feedback lever 33 to turn clockwise about the second pin 35. As a result, the connection lever 37 turns clockwise about the fifth pin 34 and this causes the servo spool 14a to move rightwards so as to accomplish its drain position. At this time, the conduit 23 communicates with the oil reservoir inside the housing 18 and the servo piston 16 of the servo cylinder 12 moves rightwards owing to the pump output pressure Pd which is applied to the smaller chamber 12b of the cylinder 12, as a result, the hydraulic fluid under pressure in the larger chamber 12a is discharged to the oil reservoir in the housing 18 through the open conduit 23. From this state, if the servo piston 16 continuously moves rightwards, the feedback lever 33 turns counterclockwise about the first pin 32 and this makes the third pin 36 turn counterclockwise about the first pin 32 and this results in the connection lever 37 turns counterclockwise about the fifth pin 34, thereby causing the servo spool 14a of the servo valve 14 to move leftwards. In accordance, the servo valve 14 changes its state from the hydraulic drain state to the neutral state and the servo piston stops its movement (see FIG. 5).

Figure 8:
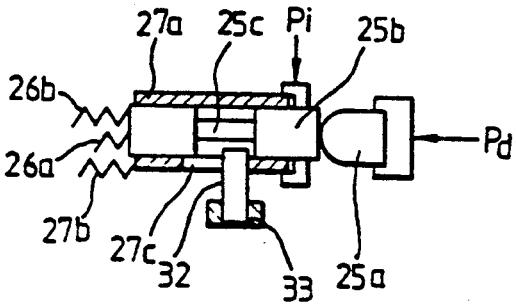
FIG. 8 is a schematic view showing a displacement of the pressure responding piston part of FIG. 7 in response to the outside pilot pressure.
Figure 9:
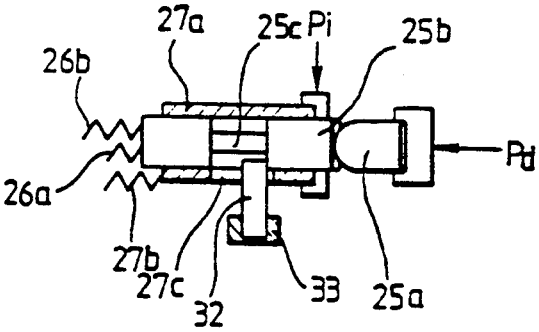
FIG. 9 is a view corresponding to FIG. 8, but showing a displacement of the part in response to the pump output pressure.

On the other hand in performing the flow rate control, as the outside pilot pressure Pi, passing through the conduit 43 in order to be received by the cylinder chamber 44, is increased, there is necessarily generated considerable hydraulic force acting on the end surface of the sleeve-type flow control piston 27a and this causes the biasing member 27b, normally biasing the flow control piston 27a rightwards, to be displaced in accordance to the hydraulic power. As a result, the flow control piston 27a moves leftwards. Here, the flow control piston 27a is provided with the longitudinal slot 27c, which preferably have the elliptic or rectangular shape and receives the first pin 32 as depicted in FIG. 8, in this respect, the leftwards movement of the flow control piston 27a causes the first pin 32 to move leftwards without interference with the pressure transfer spool 25b. In accordance, the feedback lever 33 and the connection lever 37 turn counterclockwise about the second and fifth pins 35 and 34, respectively, so that the servo spool 14a, linked to the connection lever 37 by the fourth pin 38, moves leftwards in order to accomplish its hydraulic feeding position.

At this hydraulic feeding position of the servo spool 14a, the pump output pressure Pd which is applied to the inside of the servo valve 14 through the conduit 24 is introduced to the larger chamber 12a of the servo cylinder 12. In this case, it is noted that the smaller chamber 12b of the cylinder 12 is also supplied with the pump output pressure Pd through the conduit 21, however, since the sectional area of the smaller chamber 12b is less than that of the larger chamber 12a and, in this respect, the hydraulic force generated in the smaller chamber 12b is less than that of the larger chamber 12a, the servo piston 16 moves leftwards. In accordance, the tilting pin 20 moves leftwards along with the servo piston 16 in order to make the angle of inclination of the swash plate 11, linked to the tilting pin 20 by the ball joint 22 at its end, be reduced. In result, the output flow rate Q of the pump is reduced.

On the contrary, when the pump output pilot pressure Pi, passing through the conduit 43 in order to be received by the cylinder chamber 44, is reduced, the flow control piston 27a moves rightwards by virtue of the resilient force of the biasing member 27b, as a result, the feedback lever 33 turns clockwise about the second pin 35. Thus, the connection lever 37 turns clockwise about the fifth pin 34 this results in that the servo spool 14a to move rightwards and accomplish its neutral position. Thus, there is no pump output pressure Pd in the larger chamber 12a of the cylinder 12, while the smaller chamber 12b is continuously supplied with the pump output pressure Pd through the conduit 21. In this respect, the hydraulic power in the smaller chamber 12b is higher than that of the larger chamber 12a and this causes the servo piston 16 along with the tilting pin 20 to move rightwards. The angle of inclination of the swash plate 11 is, therefore, increased in order to increase the output flow rate Q of the pump 6 (see FIG. 6).

Figure 5:
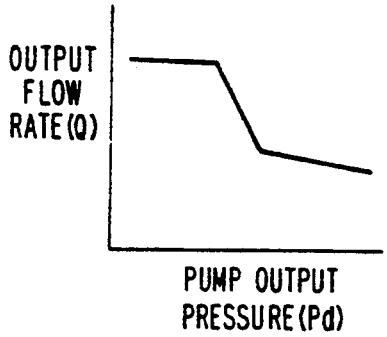
FIG. 5 is a diagrammatic view showing the relationship between the pump output flow rate and the pump output pressure.
Figure 6:
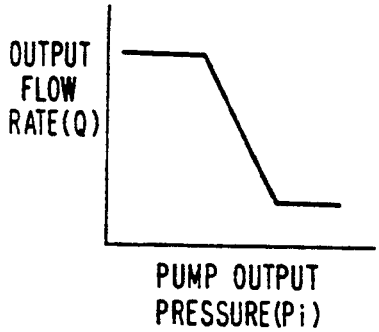
FIG. 6 is a diagrammatic view showing the relationship between the pump output flow rate and the outside pilot pressure.

The control characteristic of the output flow rate of the pump 6 with respect to the pump output pressure Pd or the outside pilot pressure Pi as shown in FIG. 5 or 6 can be adjusted by controlling the biasing forces of the biasing members 26a, 26b and 27b. In order to control the biasing forces of the biasing members 26a, 26b and 27b, it is required to adjust the adjusting screws 28 and 29 or change the lever ratio of the lever mechanism 17. On the other hand, the two characteristics can be independently adjusted and set. If described in detail, the pressure transfer spool 25b, connected to the pump output pressure responding piston 25a of the horsepower control part 25, and the sleeve-type flow control piston 27a of the flow control part 27 are provided with the small diameter middle part 25c and the longitudinal slot 27c, respectively, as described above so that it is possible to independently control the horse power and the flow rate of the pump 6 without occurrence of interference between the respective control characteristics.

On the other hand, there may be second alternate embodiment of the present invention, however, this embodiment is not shown in the accompanying drawings. In this second alternate embodiment, the pump output pressure responding piston 25a comprises a stepped piston and a conduit is additionally provided in order to connect the pump output pressure Pd of another pump to this system. Thanking for such a construction, this second alternate embodiment permits the respective pump output pressures Pd of the pumps, which concern this second embodiment, to be summed and causes the pressure transfer spool 25b and the biasing members 26a and 26b to be displaced in accordance with the summed pump output pressure. In this respect, this embodiment can accomplish a cross sensing wherein the respective horsepower controls for at least two variable displacement hydraulic pumps are performed at the same time.

Figure 10:
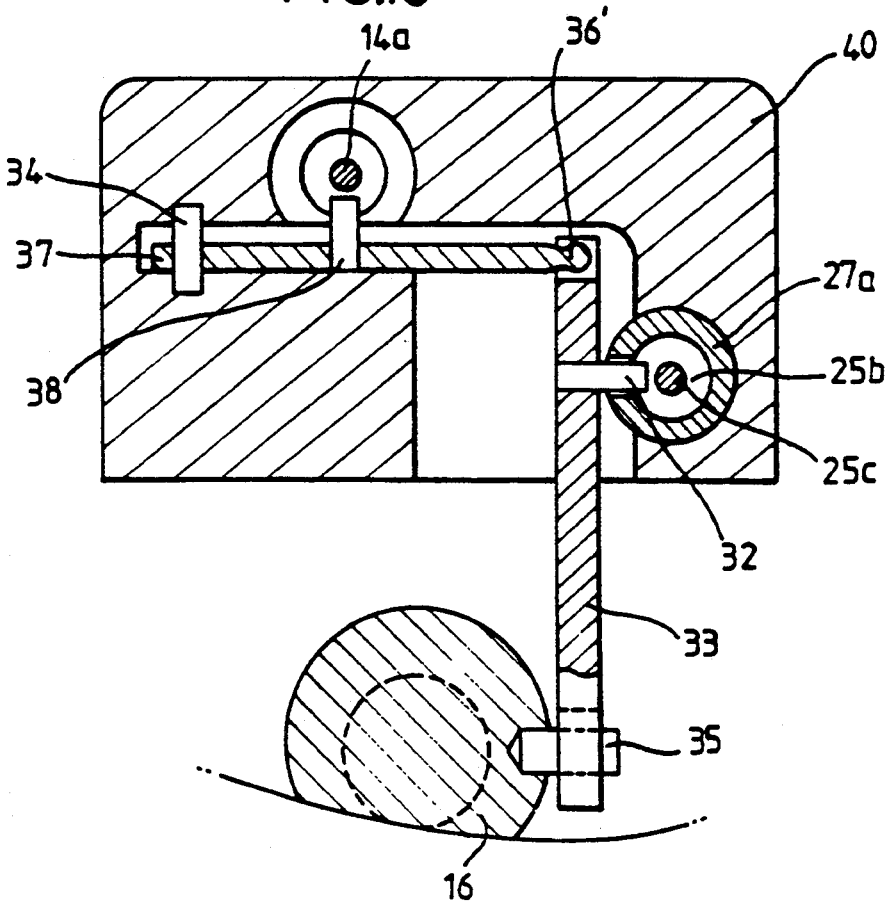
FIG. 10 is a view corresponding to FIG. 4, but showing another embodiment of a two-lever type of link mechanism.

FIG. 10 shows a third alternate embodiment of a control system of the present invention. In this third alternate embodiment, the feedback lever 33 and the connection lever 37 are arranged such that they are movably connected to each other at right angles. In order to movably vertically connect them to each other, there is provided a hinge connection 36', preferably comprising a ball joint, at which the connection ends of the levers 33 and 37 are connected to each other. In addition in this embodiment, the other end of the connection lever 37 is hinged to the frame 40 by the fifth pin 34 and the servo spool 14a is linked to a predetermined middle portion of the connection lever 37 by the fourth pin 38.

The operation effect of the third alternate embodiment shown in FIG. 10 is similar to that of the primary alternate embodiment shown in FIG. 3 even though its construction, having the aforementioned vertical arrangement of the lever mechanism, is different from that of the primary embodiment.

As described above, the present invention provides a control system for a variable displacement hydraulic pump in which the horsepower control part and the flow control part are coaxially arranged in order to be integrated with each other. In result, this system accomplishes simplicity of its construction including conduits and, in this respect, causes design thereof to be facilitated and accomplishes compactness. In addition, since the number of connections for connecting the feedback lever to the connection lever of the feedback lever mechanism is reduced due to appliance of the two-lever type of lever mechanism instead of the conventional three-lever type of lever mechanism, variation of control characteristics caused by the accumulated abrasion of the connections is minimized and this causes endurance and reliability of the control system to be substantially improved. Furthermore, the present control system causes displacements of both the servo spool of the servo valve and the biasing members of the pressure responding ram to be minimized owing to the two-lever type of feedback lever mechanism, thereby accomplishing compactness.

Although the preferred embodiments of the present invention have been disclosed for illustrative purpose, those skilled in the art will appreciate that various modifications, additions and substitutions are possible, without departing from the scope and spirit of the invention as disclosed in the accompanying claims.

What is claimed is:

1. A control system for a variable displacement hydraulic pump comprising:

a pressure responding ram for causing, upon receiving pump output pressure or outside pilot pressure, a servo spool of a servo valve to be displaced, said ram comprising a horsepower control part which is displayed in response to said pump output pressure and a flow control part which is displaced in response to said outside pilot pressure, said control parts being coaxially arranged in order to be integrated with each other;

said servo valve for causing a larger chamber of a servo cylinder to be selectively supplied with the pump output pressure, the servo valve having said servo spool therein, the servo spool displacing, in accordance with the displacement of said pressure responding ram, between a hydraulic feeding position, a neutral position and a drain position;

said servo cylinder for controlling angle of inclination of a swash plate of said pump in order to control the pump output flow rate, said servo cylinder enclosing a servo piston which divides the inside of the servo cylinder into smaller and larger chambers, said smaller chamber being always supplied with the pump output pressure and said larger chamber communicating with the inside of said servo valve through a conduit in order to be selectively supplied with the pump output pressure; and a two-lever type of feedback lever mechanism for linking said pressure responding ram, said servo spool of the servo valve and said servo piston of the servo cylinder to each other, said mechanism comprising:

a feedback lever being linked at one end thereof to the servo piston and at the other end thereof to both the horsepower control part and the flow control part of the pressure responding ram; and a connection lever being linked at one end thereof to said feedback lever, hinged at the other end thereof to a frame of said control system and linked at its predetermined middle portion to the servo spool of the servo valve, whereby said control system independently simultaneously controls constant horsepower and flow rate of the pump in accordance with both the pump output pressure and the outside pilot pressure which are supplied to the pressure responding ram.

2. A control system according to claim 1, wherein said feedback lever and said connection lever are arranged in order to be parallel to each other.

3. A control system according to claim 1, wherein said feedback lever and said connection lever are arranged in order to be at right angle to each other.

4. A control system according to claim 1, wherein said horsepower control part of the pressure responding ram comprises:

a pump output pressure responding piston which is movable in response to said pump output pressure;

a pair of biasing members for normally biasing said pump output pressure responding piston in a direction opposite to the pump output pressure; and a pressure transfer spool being disposed between said pressure responding piston and said biasing members in order to transfer the pressure therebetween, said pressure transfer spool being linked to said feedback lever, and said flow control part comprises:

a sleeve-type flow control piston which is movable in response to the outside pilot pressure, said flow control piston being linked to said feedback lever and movably fitted around said pressure transfer spool of the horsepower control part; and a biasing member for normally biasing the flow control piston in a direction opposite to the outside pilot pressure.

5. A control system according to claim 4, wherein said pressure transfer spool of the horsepower control part is provided with a middle part having a smaller diameter than the other part and said flow control piston of the flow control part is provided with a longitudinal slot, thereby permitting a pin to be inserted in an annular recess provided by said smaller diameter middle part through said longitudinal slot in order to link said pressure responding ram to said feedback lever.

6. A control system according to claim 4, wherein said biasing members of both the horsepower control part and the flow control part comprise a compression coil spring, respectively.

7. A control system according to claim 4, wherein said control system further comprises at least one adjusting screw for adjusting the biasing force of the biasing members of the horsepower control part.

* * * * *